United States Patent [19]

Gogneau

[11] 4,159,881

[45] Jul. 3, 1979

[54] TURBULENT FLOW CONVEYING DEVICE FOR A MIXTURE

[76] Inventor: Achille Gogneau, 17, Avenue Jules Ferry, Montlucon, France, 03100

[21] Appl. No.: 827,683

[22] Filed: Aug. 28, 1977

[30] Foreign Application Priority Data

Sep. 2, 1976 [FR] France ..... 76 26823

[51] Int. Cl.[2] ..... B01F 5/00

[52] U.S. Cl. ..... 366/337; 48/180 R; 138/42; 366/338; 366/341

[58] Field of Search ..... 366/101, 336, 337, 338, 366/340, 341; 138/37, 40, 42, 43, 44; 48/180 R, 180 A, 180 B, 180 M, 144; 123/141, 122 D

[56] References Cited

U.S. PATENT DOCUMENTS

| | | | |
|---|---|---|---|
| 2,789,041 | 4/1957 | Falzone | 48/180 R |
| 2,992,084 | 7/1961 | Schropp | 48/180 R |
| 3,467,072 | 9/1969 | Toesca | 123/141 |
| 3,645,243 | 2/1972 | Ohlsson | 123/141 |
| 3,849,086 | 11/1974 | Johnson | 48/180 C |
| 3,938,967 | 2/1976 | Reissmuller | 48/180 R |

*Primary Examiner*—Leonard D. Christian
*Attorney, Agent, or Firm*—Darby & Darby

[57] ABSTRACT

A mixing device for conveying a fuel mixture into the inlet manifold of a combustion engine formed by an outer casing having an inlet pipe for the fuel components to be treated connected to the casing. A system of inclined blades is disposed in the casing for dividing the mixture into thin layers and a system formed by two co-axial truncated cones placed tip to tip provided radially inwardly of, and co-axial with the system of blades. The material to be treated is fed through a ring of jet nozzles surrounding at least one of the truncated cones and through a Venturi tube located downstream of the system to increase the turbulence during movement of the mixture.

9 Claims, 3 Drawing Figures

TURBULENT FLOW CONVEYING DEVICE FOR A MIXTURE

FIELD OF THE INVENTION

The present invention relates to a stirring and conveying device for a mixture comprising at least one gas and more particularly to a device for improving the composition of the air and fuel mixture for internal combustion engines.

BACKGROUND AND SUMMARY OF THE INVENTION

Some of the accessories for internal combustion engines include, for instance, acceleration jets, which project the fuel directly into the inlet manifold. The result of such a device is bad combustion, a noticeable loss of power and an excessive and dangerous pollution level at the exhaust.

The device according to the invention ensures that such disadvantages will be avoided by improving the mixture. The rolling, stirring and bursting of the particles produced by the device of the invention provide an enhanced mixture of the components which favors an almost total combustion of the fuel, lowers the carbon dioxide content to a value near zero at the exhaust and considerably improves the engine efficiency.

To this effect, a preferred embodiment of the device according to the invention comprises:

an outside casing, an inlet piping for the mixture to be treated, a conical system made of blades inclined in relation to the side surface of the system and forming between themselves a very narrow gap for dividing the mixture into layers of very small thickness and impart to said layers a swirling movement, a system formed by two co-axial truncated cones comprising at its upstream end a ring provided with jets and at its downstream end an annular passage of the venturi type, the casing, the conical system with blades and the system formed by the two truncated cones being co-axial, According to an embodiment of the invention, the supply is provided at the base of the casing and the device comprises a second blade system through which the mixture flows before reaching the ring.

According to another embodiment of the invention, one of the two truncated cones of said system is formed by the outside casing and the supply is provided along the device axis.

The invention will become more apparent from the following description of two non limitative embodiments thereof when taken in conjunction with the accompanying drawings wherein;

DETAILED DESCRIPTION

Figure 1:
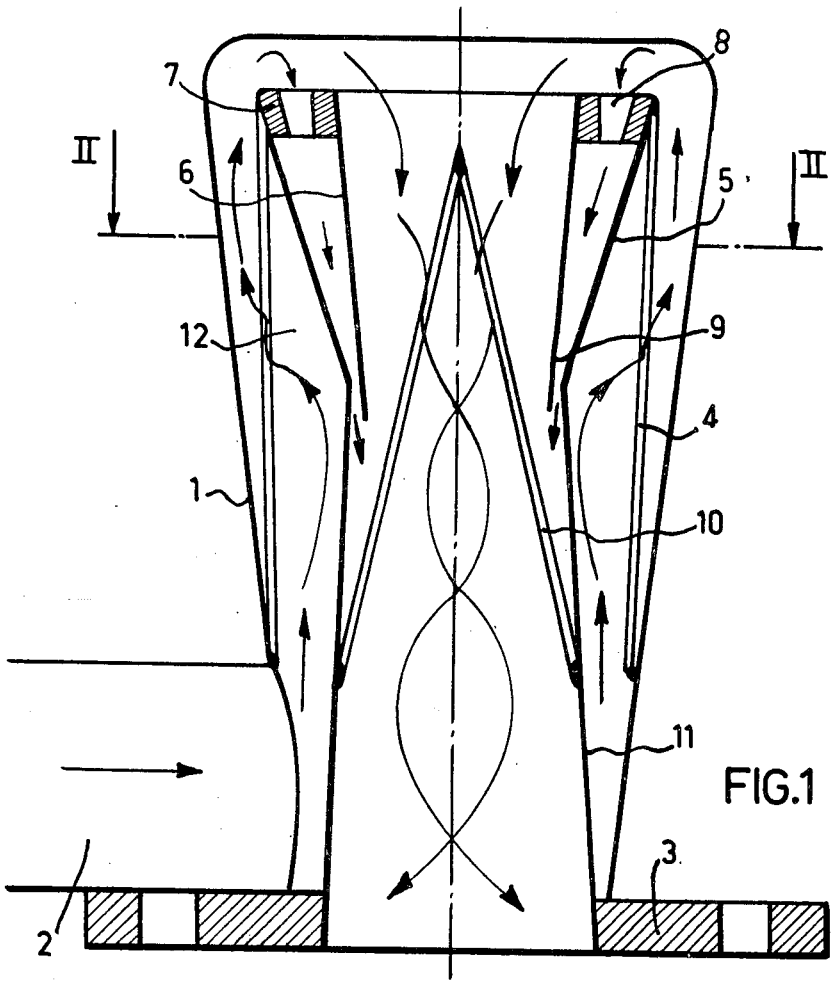
FIG. 1 is a cross-sectional axial view of a first embodiment of the invention.
Figure 2:
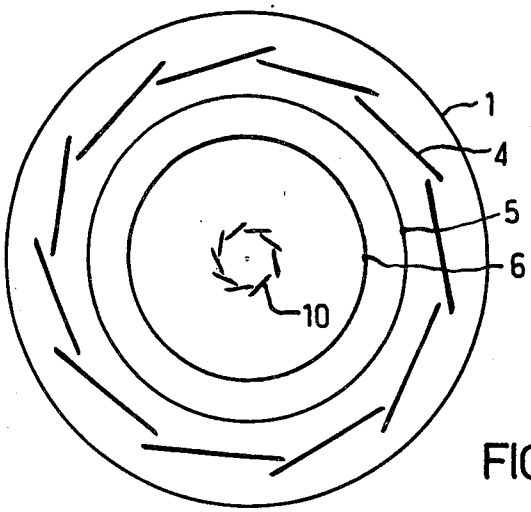
FIG. 2 is a cross-sectional view taken along line II—II of FIG. 1.

The device according to FIG. 1 comprises a casing 1, of a semi-conical shape having a closed upper end and an inlet piping 2 for the mixture and a fixation clamp 3 at the lower end of the casing. A first blade system is formed by the blades 4 arranged according to a somewhat cylindrical surface and inclined relative to said somewhat cylindrical surface so that the gaps separating them are as small as possible, is fixed inside casing 1 above piping 2. Its lower portion is welded to casing 1 while its upper portion is welded to the upper wide base of a frustoconical part 5 having a nozzle 11 at its lower end which is also frustoconical. Nozzle 11 extends from its upper narrow tip and grows larger down to the outlet of the device. Inside part 5 is another frustoconical part 6, co-axial with casing 1, blade system 4, part 5 and nozzle 11. Said part 6 is fixed via its upper portion to an annular ring 7 which is itself connected to the blade system 4 and formed on its periphery with passages 8 in the form of jets. The axes of the jets 8 are inclined relative to the device axis. The lower portion of part 6 forms with that of part 5 an annular neck 9 acting as a venturi passage. Finally, a second blade system 10 of generally conical shape, is placed inside of nozzle 11 and part 6 with its tip adjacent the ring 7. The lower ends of the blades 10 are fixed, such as by welding, to the inner wall of nozzle 11.

Due to the reduced pressure created in the engine cylinder, the mixture arriving from the carburetor (not shown) is sucked by piping 2 and flows through the first blade system 4 where the fuel droplets are discharged in very fine particles and where the mixture, which is divided in very thin layers, assumes a swirling movement due to the inclination of the blades 4. The mixture then arrives above the system formed by the frustoconical parts 5 and 6 and ring 7. One portion flows directly into the base of the frustoconical part 6 while the other portion passes through the jets 8 of ring 7 where the speed is increased and out through the venturi 9 into the nozzle opening. The whole mixture flows then through the second blade system 10 which increases the swirl and again divides the mixture into very fine layers. The mixture finally reaches the inlet manifold (not shown) via nozzle 11.

By arranging an annular chamber above ring 7, an additive under pressure (for instance compressed air) may be directed to jets 8, the mixture from piping 2 flowing then only inside frustoconical part 6.

Figure 3:
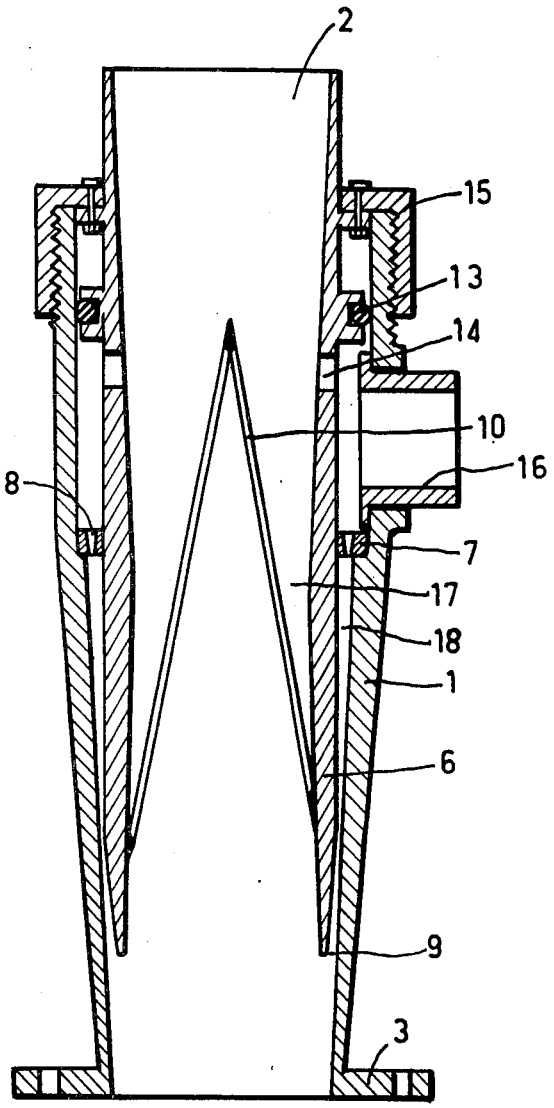
FIG. 3 is a cross-sectional axial view of a second embodiment according to the invention.

Stirred in this way, the mixture is more thoroughly mixed and fuel combustion more complete due to the reduced dimensions of the droplets. There is shown in FIG. 3, where the corresponding elements have the same reference numerals as those of FIG. 1.

The device comprises a casing 1, a central body 36 the inside cross-section of which forms a neck 17, with the conical blade system 10 which is mounted therein. The central body 36 is secured inside casing 1 via a screw threaded cap 15 integral with it. The fluid-tightness of the whole assembly is provided by an O-ring seal. The mixture is sucked into piping 2 due to the depression prevailing in the engine cylinder, and flows through the blade system 10 which divides the fuel droplets, divides the mixture in very thin layers, and imparts to it a swirling movement.

The suction from the engine tends to create simultaneously a reduced pressure in the annular space 18 situated between the central body 36 and casing 1, causing part of the mixture to flow through apertures 14 and/or from an auxiliary piping 16. This part of the mixture flows through the inclined jets 8, assumes a swirling movement and is accelerated at outlet 9, a venturi passage being formed in the annular space 18. As in the previous embodiment, the mixture is stirred and therefore better mixed, causing a better fuel combustion. Engine efficiency is therefore improved and the pollution rate at the exhaust reduced.

What we claim is:

1. A stirring and conveying device for a fuel-air mixture comprising:

a housing, means for supplying the mixture to be treated to said housing, a first blade means for receiving a part of the material to be treated, said first blade means including a plurality of first blades arranged in a generally conical configuration with the surfaces of the respective first blades being inclined to divide the mixture into layers and to impart a swirling motion to said layer, and means for receiving another part of the mixture at an inlet thereof and to impart thereto an increased velocity at an outlet of said receiving means, at least one of said first blade means and said receiving means being formed to mix the materials exiting the outlets by a venturi action.

2. A device as in claim 1 wherein said receiving means comprises a pair of truncated cones which are coaxial, said cones having at their upstream ends means for receiving the mixture and for discharging it as jets into the area between the cones, the downstream ends of the cones producing a venturi.

3. A device according to claim 2 wherein one of the two truncated cones of said receiving means is formed by the housing and the mixture is supplied by said supplying means along the device axis.

4. A device according to claim 1 wherein the means producing the jets are inclined relative to the device axis so as to impart a swirling movement to the mixture flowing through them.

5. A device according to claim 1 further comprising inlet means upstream of the means for producing the jets for bringing an additional component to the mixture.

6. A device as in claim 2 wherein the means for forming the jets comprises a ring with apertures therein.

7. A device as in claim 2 wherein said first blade means is coaxial with said pair of truncated cones.

8. A device as in claim 1 further comprising a second blade means upstream of said first blade means and said receiving means for dividing the mixture into layers.

9. A device as in claim 2 further comprising a second blade means upstream of said first blade means and said receiving means for dividing the mixture into layers.

* * * * *